US007913870B2

(12) United States Patent
Vovan

(10) Patent No.: US 7,913,870 B2
(45) Date of Patent: Mar. 29, 2011

(54) TAMPER EVIDENT CONTAINER

(75) Inventor: Terry Vovan, Rialto, CA (US)

(73) Assignee: Pactiv Corporation, Lake Forest, IL (US)

( * ) Notice: Subject to any disclaimer, the term of this patent is extended or adjusted under 35 U.S.C. 154(b) by 1017 days.

(21) Appl. No.: 11/414,847

(22) Filed: May 1, 2006

(65) Prior Publication Data

US 2006/0255054 A1 Nov. 16, 2006

Related U.S. Application Data

(60) Provisional application No. 60/679,321, filed on May 10, 2005.

(51) Int. Cl.
*B65D 41/00* (2006.01)

(52) U.S. Cl. ..... 220/359.1; 206/459.1; 215/230; 220/377; 220/793; 428/915; 283/94; 283/108

(58) Field of Classification Search ..... 206/459.1; 215/230; 220/359.1, 377, 793; 428/915; 283/94, 108

See application file for complete search history.

(56) References Cited

U.S. PATENT DOCUMENTS

| | | | | |
|---|---|---|---|---|
| 2,004,449 | A * | 6/1935 | Stanley | 220/784 |
| 2,161,561 | A | 6/1939 | Dalton | |
| 3,495,759 | A * | 2/1970 | Bergstrom et al. | 220/270 |
| 3,896,965 | A | 7/1975 | Cornell | |
| 3,935,960 | A | 2/1976 | Cornell | |
| 4,098,577 | A | 7/1978 | Halpern | |
| 4,424,911 | A | 1/1984 | Resnick | |
| 4,432,462 | A | 2/1984 | Newkirk | |
| 4,436,203 | A | 3/1984 | Reyner | |
| 4,449,632 | A | 5/1984 | Marusiak | |
| 4,475,661 | A | 10/1984 | Griffin | |
| 4,489,841 | A | 12/1984 | Thompson | |
| 4,526,752 | A | 7/1985 | Perlman et al. | |
| 4,557,505 | A | 12/1985 | Schaefer et al. | |
| 4,591,055 | A | 5/1986 | Corn | |
| 4,645,078 | A | 2/1987 | Reyner | |

(Continued)

FOREIGN PATENT DOCUMENTS

| | | |
|---|---|---|
| EP | 0109793 | 5/1984 |

(Continued)

*Primary Examiner* — Anthony Stashick
*Assistant Examiner* — Elizabeth Volz
(74) *Attorney, Agent, or Firm* — Baker Botts LLP

(57) ABSTRACT

An improvement to a container of the type that includes a vacuum formed transparent base and lid, the container having opposite sides that each forms a base flap (20) and a lid flap (22) that lie adjacent and parallel to each other, wherein the container indicates if it has been opened after a store clerk has loaded food into the container. An indicator sheet (34) lies between the base and lid and has cut-out characters (60) lying in holes (62) of a carrier (64), the carrier being bonded to the base flap and the characters being bonded to the lid flap. The container is opened by a person pulling up the lid flap, with the characters lifting out of their holes as they move up with the lid flap, and with the carrier that forms the character holes remaining on the base flap. When the lid is closed by pressing down the lid flap against the base flap, there will be some misalignment of the characters with the holes that they previously lay in, creating gaps that are readily noticeable. The gaps can spell much of a word such as "opened".

14 Claims, 3 Drawing Sheets

U.S. PATENT DOCUMENTS 4,678,082 A 7/1987 Fillmore
4,685,578 A 8/1987 Dunshee
4,746,061 A 5/1988 Arvanigian
4,757,898 A 7/1988 Klein
4,813,541 A 3/1989 Velasco et al.
4,834,552 A 5/1989 Makowka
4,865,198 A 9/1989 Butler
4,877,143 A 10/1989 Travisano
4,883,182 A 11/1989 Hughes
4,890,763 A 1/1990 Curiel
4,911,302 A 3/1990 Butler
4,931,327 A 6/1990 Liu et al.
4,945,708 A 8/1990 Curiel
4,986,429 A 1/1991 Singleton, Jr.
5,042,653 A 8/1991 Ems
5,064,664 A 11/1991 Hustad et al.
5,103,979 A 4/1992 Hustad
5,137,208 A 8/1992 Wang et al.
5,149,578 A 9/1992 Wheatley et al.
5,312,680 A 5/1994 Simpson
5,798,169 A 8/1998 Smith
5,866,183 A 2/1999 Small
5,882,116 A 3/1999 Backus
6,264,033 B1 7/2001 Kannabiran et al.
6,564,958 B1 5/2003 Ramsey et al.
6,877,631 B1 4/2005 Thompson et al.
6,916,516 B1 7/2005 Gerber et al.
7,141,286 B1 11/2006 Kessler et al.
7,178,867 B2 2/2007 Hough
7,201,410 B1 4/2007 Lassen
7,223,015 B2 5/2007 Steffens
7,270,874 B2 9/2007 Dalgleish
7,273,139 B2 9/2007 Lantz
7,344,744 B2 3/2008 Sierra-Gomez et al.
7,360,807 B2 4/2008 Graves
7,364,210 B2 4/2008 Schainholz et al.
7,371,008 B2 5/2008 Bonenfant
RE40,357 E 6/2008 Geyer
7,422,781 B2 9/2008 Gosselin
7,475,805 B2 1/2009 Visser
7,530,740 B2 5/2009 Geyer
7,568,586 B2 8/2009 Walters, Jr.
7,579,061 B2 8/2009 Dronzek, Jr.
7,594,348 B2 9/2009 Oosterlinck
7,681,732 B2 3/2010 Moehlenbrock et al.
7,695,809 B1 4/2010 Maksymkiw et al.
7,740,292 B1 6/2010 Fattori et al.
7,740,923 B2 6/2010 Exner et al.
7,767,295 B2 8/2010 Steinzor
2001/0022280 A1 9/2001 Kannabiran et al.
2004/0150221 A1 8/2004 Brown
2004/0188304 A1 9/2004 Bonnette et al.
2005/0247764 A1* 11/2005 Sierra-Gomez et al. ... 229/87.08
2006/0018569 A1* 1/2006 Bonenfant ..... 383/5
2006/0108405 A1 5/2006 Sanchez et al.
2006/0234014 A1 10/2006 Liu et al.
2006/0234040 A1* 10/2006 Liu et al. ..... 428/343
2006/0255054 A1 11/2006 Vovan
2007/0054117 A1 3/2007 Katchko et al.
2007/0071968 A1 3/2007 Hermony et al.
2007/0082163 A1 4/2007 Bolnick et al.
2007/0133909 A1 6/2007 Arvizu
2007/0275133 A1 11/2007 Sierra-Gomez et al.
2007/0284372 A1 12/2007 Gnepper
2008/0029345 A1 2/2008 Shafir
2008/0056622 A1 3/2008 Austreng et al.
2008/0217931 A1 9/2008 Bourrieres et al.
2008/0308613 A1 12/2008 Freder
2008/0314904 A1 12/2008 Perra
2009/0050253 A1 2/2009 Thomas et al.
2009/0084700 A1 4/2009 Visser et al.
2009/0117307 A1 5/2009 Culbertson et al.
2009/0166228 A1 7/2009 Kinunen
2009/0294531 A1 12/2009 Kantorwitz et al.
2009/0301633 A1 12/2009 Myers et al.
2010/0012542 A1 1/2010 Methuen
2010/0102109 A1 4/2010 Flecker et al.
2010/0126894 A1 5/2010 Koukol et al.
2010/0147724 A1 6/2010 Mitra-Shah et al.
2010/0178394 A1 7/2010 Exner et al.
2010/0181371 A1 7/2010 Messmer et al.

FOREIGN PATENT DOCUMENTS

GB 2268731 1/1994

* cited by examiner

TAMPER EVIDENT CONTAINER

CROSS REFERENCE

Applicant claims priority from U.S. Provisional patent application Ser. No. 60/679,321 filed May 10, 2005.

BACKGROUND OF THE INVENTION

Food is often placed in a transparent plastic container that includes a base with a large volume cavity that holds the food and with a cover that closes the cavity. Buyers want to be assured that, after the food has been placed in the container, as by a clerk wearing plastic gloves at the food store, that the container has not been opened. There is a possibility that a customer will secretly open the container enough to taste a bit of the food before closing it (and possibly leave his/her germs in the food), and potential buyers want to know whether this has happened. A device that could be installed by the manufacturer of the containers, which could be almost automatically activated by a clerk at the food store when the container was filled and initially closed, and which indicated to customers when a container has been opened, would be of value. Food containers are sold at low costs so any such device should be of low cost and be easily activated by a store clerk.

SUMMARY OF THE INVENTION

In accordance with one embodiment of the present invention, a container, especially a food container, is provided with a low cost and easily activated means that indicates when the container has been opened after goods such as food was loaded into the container. The container is of the type that includes a base and lid that are each constructed of deformed plastic sheet, with at least the lid being of transparent material. At least first sides of the base and lid form flaps that lie parallel and adjacent to one another. The indicating means includes a character sheet having cuts that form holes and forming characters within the holes. The character sheet portion other than the characters that lie in the holes, forms a carrier that lies outside the holes. The indicator sheet is usually an elongated strip that is placed between the base and lid flaps. When the indicator sheet is activated and the lid is closed, the carrier of the indicator sheet is adhesively bonded to the base flap, while the characters are adhesively bonded to the lid flap. When the container is next opened, the characters stick to the lid flap and pull out of holes in the carrier, and when the lid is closed again the characters will not fit precisely into the holes in the carrier that they were pulled out of. The misalignment is highly noticeable, and shows that the container was opened after the food was loaded.

The base and lid flap are latched together by a latch mechanism that causes the lid flap to shift rearward as it is being pushed down to close the container. As a result, the characters on the lid flap are shifted rearward before the lid is fully closed, causing misalignment.

The character sheet can be formed of an adhesive sheet that has sticky surfaces on both of its faces and that has front and rear edge sections. The characters lie between the front and rear edge sections of the adhesive sheet. Highly adhesive strips can be attached to the bottom of the front and rear edges of the adhesive sheet to cover only the carrier. The highly adhesive strips hold the carrier down to the base flap, while the tacky upper surface of the adhesive sheet pulls at least some of the characters our of the adhesive sheet as the lid flap is pulled up.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
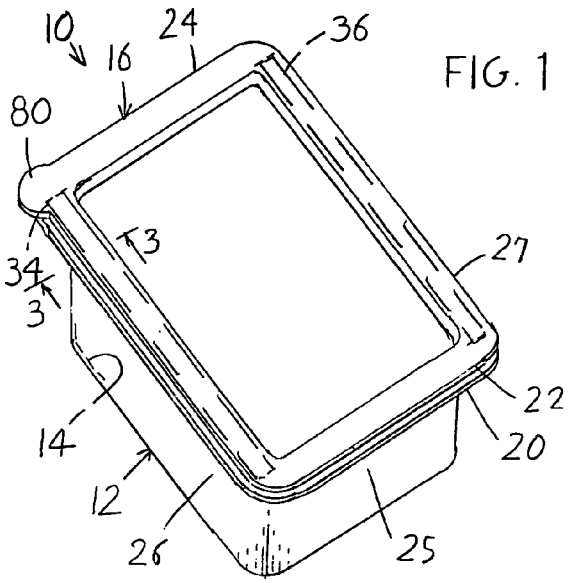
FIG. 1 is a top isometric view of a container of the present invention, shown in the initially closed position.
Figure 3:
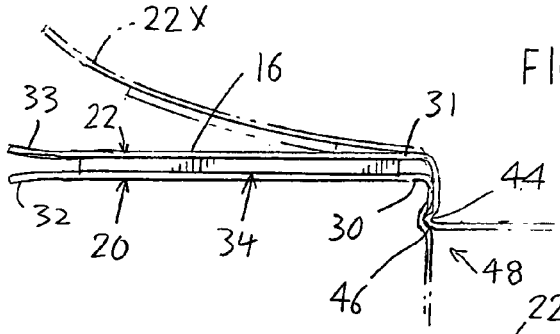
FIG. 3 is a sectional view taken on line 3-3 of FIG. 1, and showing in phantom lines the lid being raised during opening of the container.

FIG. 1 illustrates a container 10 that is especially useful to hold food, which includes a base 12 that forms a food-holding cavity 14, and a cover or lid 16 that covers the cavity and that can be said to form top walls of the cavity. Both base and lid are constructed of vacuum formed transparent plastic sheets. The base and lid are each of generally rectangular shape and have peripheral portions at each of their four sides 24-27, in the form of base flaps 20 and lid flaps 22. The base flaps 20 and lid flaps 22 at each side of the container, lie in parallel planes, and lie adjacent to each other. The lid has a tab 80 that can be lifted to open the container. As shown in FIG. 3, each flap 20, 22 has a mounted edge portion 30, 31 that merges with the rest of the base or lid, and has a free edge portion 32, 33 that is free to be bent up and down. Applicant places an indicator sheet 34 along at least one side of the container, with FIG. 1 showing a pair of indicator sheets 34, 36 at opposite sides of the container, to indicate when the container has been opened, the particular indicator strips being of white colors when viewed from above.

Figure 2:
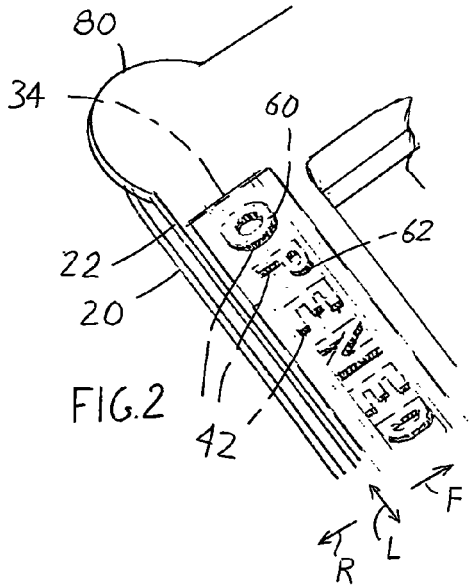
FIG. 2 is an isometric view of a portion of the container of FIG. 1 after food has been loaded into the container and the lid was closed, and the container has been again opened and closed.

When the container has been initially closed after food has been placed in the container, the container appears "normal" with only two continuous (no gaps) white indicator strips 34, 36 seen lying at the container opposite sides between the base and lid. However, if the container thereafter has been opened and reclosed, then an anomaly appears as shown in FIG. 2, with gaps 42 and pieces of letters easily seen. The container still can be opened and closed, but the fact that it was initially opened is obvious.

FIG. 3 shows that the lid flap 22 can be opened by lifting the lid flap free edge portion 33 up away from the base flap free edge portion 32, with the lid flap at 22 X being bent to have a concave upper surface, until a lid projection 44 snaps out of a base recess 46. The lid projection 44 and base recess 46 form a releasable latch mechanism 48.

Figure 4:
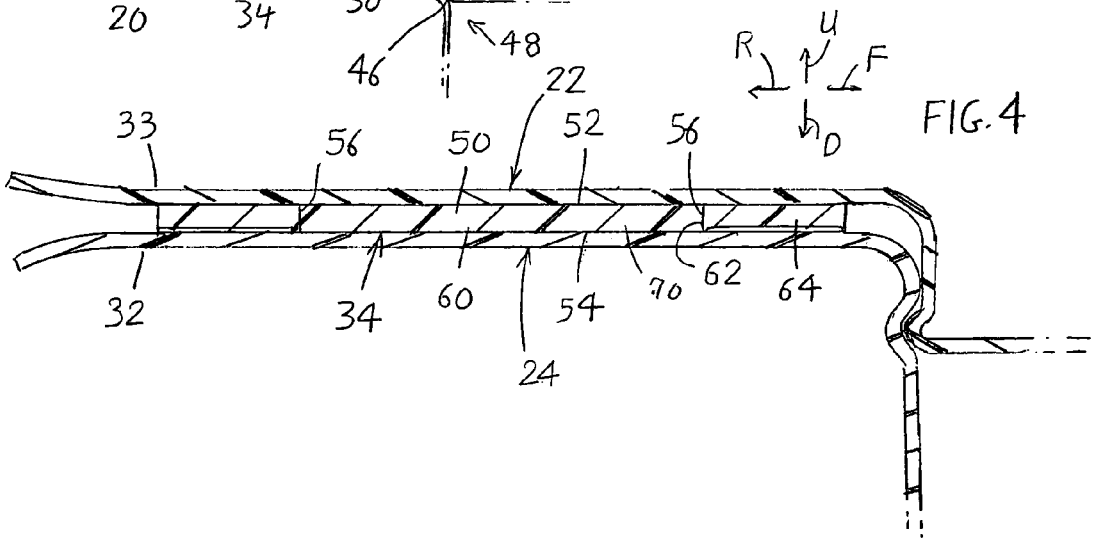
FIG. 4 is an enlarged sectional view of FIG. 3.
Figure 5:
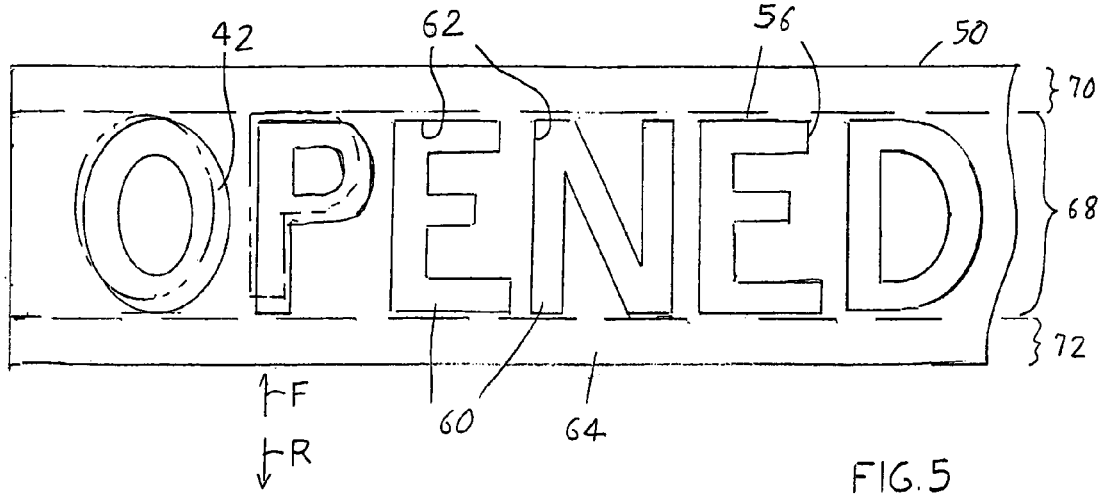
FIG. 5 is a plan view of a portion of FIG. 2, after the container has been opened and closed following the loading of goods 14 into the container.

FIG. 4 shows the initially closed container, with an indicator sheet or strip 34 lying between the base and lid flaps. The indicator strip comprises a character sheet or strip (which is not necessarily elongated) 50 into which at least one character is cut. In FIG. 4, the character sheet 50 is an adhesive strip or band of "sticky" material with both its top surface 52 and its bottom surface 54 being adhesively held, with only moderate adhesive strength, respectively to the lid flap 22 and to the base flap 24. The term "adhesive strength" is used here to indicate the force required to pull off a unit area such as 0.5 $inch^2$ or peel it off. The indicator strip 34 has cuts 56 that form characters 60 such as letters, numbers, or a fanciful image and that form holes 62 in which the characters lie. The indicator strip also forms a carrier 64 in which the holes 62 have been formed. FIG. 5 shows the cuts 56 forming letter characters 60 that spell "OPENED" in a middle section or region 68 of the indicator strip. The middle region 68 lies between front F and rear R regions 70, 72 of the indicator strip.

Initially, the characters 60 lie in the openings or holes 62 of the carrier strip middle region, with the characters precisely matching the shape and positions of the holes and being precisely aligned with the holes, as a result of the letters being left in place in the strip after the cuts are made. However, when the lid and base flaps are separated to open the container to gain access to the food-holding cavity, some or all of the characters 60 stick to the lid flap while the carrier portion, or carrier 64 sticks to the base flap. This is because the character upper face is adhesively held to the lid flap by a first holding strength but the lower face of the character is not held to the base flap with the first holding strength. This is, the character lower face is held to the base flap by a lower or zero holding strength. Similarly, the carrier lower face is held to the base flap by a second holding strength, but the carrier upper face is held by a lower or zero holding strength to the lid flap.

Figure 6:
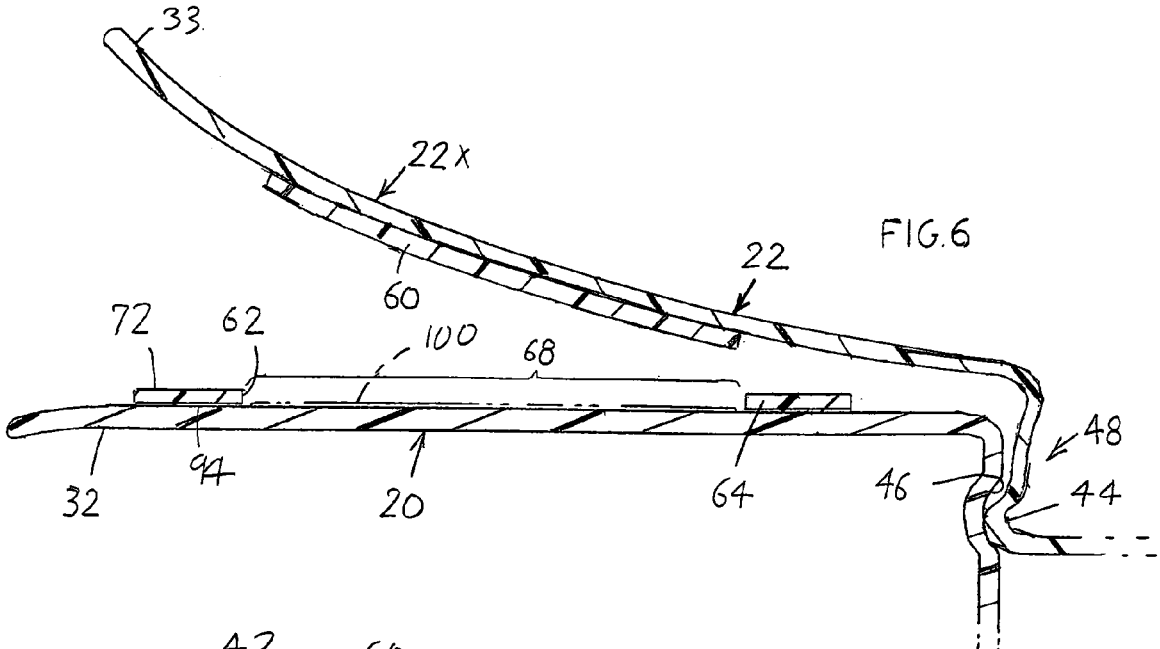
FIG. 6 is an enlarged view of FIG. 3 showing the upper flap being initially lifted to open the container following the loading of goods into the container.

FIG. 6 shows the lid flap 22X as the container is being opened, when the lid flap free edge portion 33 is bent upward before the lid projection 44 has pulled out of the base recess 46. The lid projection and base recess form the latch mechanism 48 that shifts the lid as it is replaced on the base, as described below. A character 60 has been pulled out from of a corresponding hole 62 in the carrier 64 to rise with the lid flap. At the same time, a part of the base flap 20 is usually held down by a person's finger and may be bent down. The carrier 64 of the indicator sheet remains stuck on the base flap 20.

Figure 7:
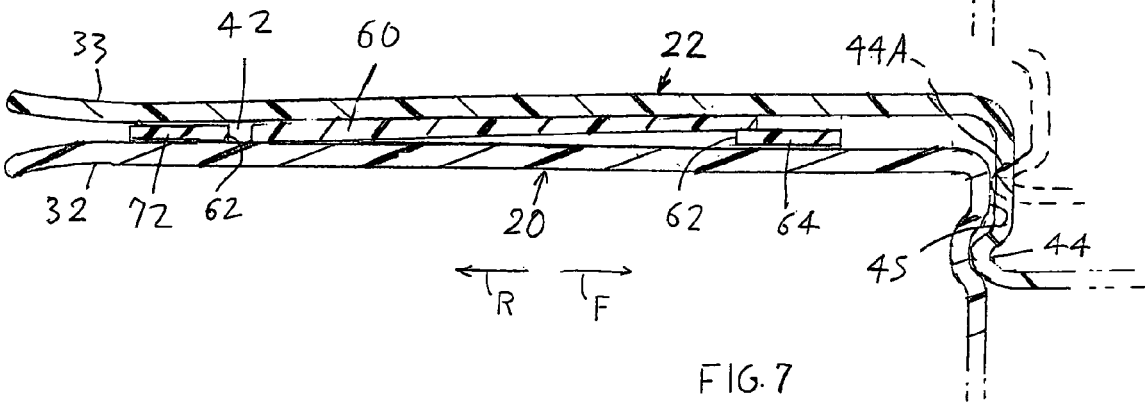
FIG. 7 is a view similar to FIG. 6, showing in phantom lines a portion of the lid flap in the course of closing, and showing in solid lines the lid flap pressed down fully to close the container, all following the opening step of FIG. 6.

FIG. 7 shows the lid flap 22 of FIG. 6 with the character 60 thereon as the lid flap is being closed onto the base flap 20, after having been previously opened. The lid flap (and to some extent the base flap, also) is bent differently during opening, when the lid flap is initially lifted, compared to bending that occurs during closing when the lid flaps may be simply pushed down. One difference is that the free edge portion 33 of the lid flap is usually pushed down towards the base flap 20, causing the character 60 to stick to the carrier 64, as the lid projection at 44A moves down across a base inner surface 45. As a result, the position of the character 60 in FIG. 7 has shifted forward F when the lid flap is closed, and the character 60 will not be fitted precisely into the hole 62 of the carrier 64. The result is that the character is shifted and/or skewed, with part of the character lying on top of the carrier 64 and part lying in the carrier hole 62 from which the letter was pulled out. The resulting gaps such as shown at 42 in FIG. 7 and FIG. 2, and some of the letters, spell the word "opened" and can be readily seen by a person. Thus, if a person sees some of the letters of "opened" and sees the messy arrangement of letters lying only partially in the corresponding holes, the person is informed that the container has been opened.

Figure 8:
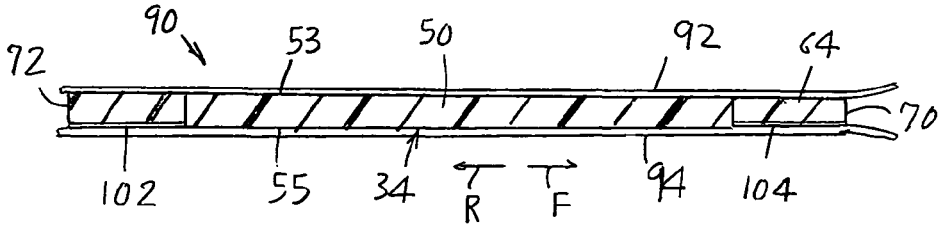
FIG. 8 is a sectional view of an indicator sheet prior to its mounting on flaps of the container, and with peel-off protective sheets on its top and bottom faces.
Figure 9:
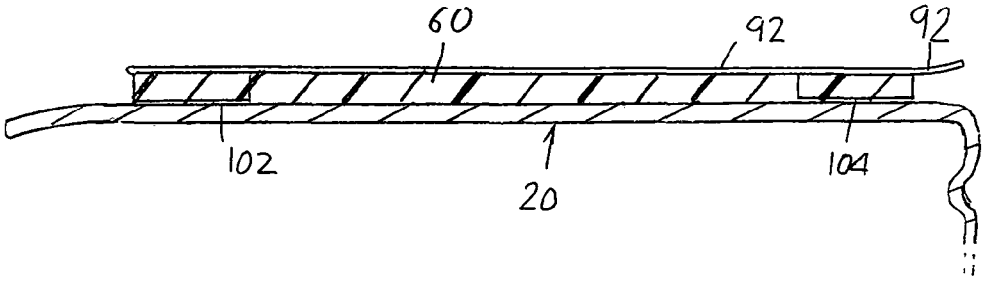
FIG. 9 is a sectional view similar to FIG. 8, after the lower protective sheet has been removed and the indicator sheet has been pressed against the base flap.

FIG. 8 shows a strip assembly 90 which includes the original indicator strip 34 as it is supplied to the manufacturer of containers. The strip assembly includes the adhesive sheet, or sheet of "sticky" material 50 and top and bottom peel-off protective sheets or strips, or protectors 92. 94 lying against the opposite faces 53, 55 of the character sheet 50. FIG. 8 shows highly adhesive layers 102, 104 lying on the bottom surface of the front and rear edge regions 70, 72 of the carrier 64, to securely hold the carrier to the base flap. FIG. 9 shows the indicator sheet after the bottom protector strip 94 has been removed, so only the upper protector strip 92 remains. As a result, the highly adhesive strips 102, 104 adhere to the base flap 20. The highly adhesive strips can be layers sprayed or brushed on by the manufacturer. Usually it is the manufacturer of the container base and lid who has removed the lower protector strip and pressed the highly adhesive strips against the base flap, and then ships the base and lid to food stores with the top peel-off protective sheet 92 in place.

Figure 10:
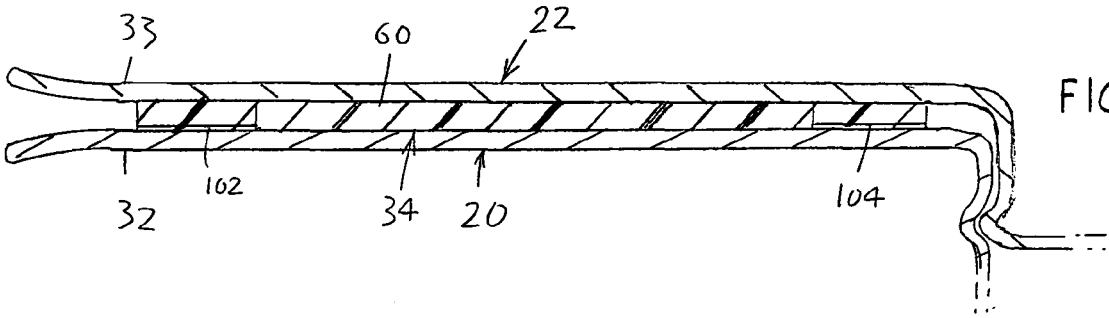
FIG. 10 is a sectional view similar to FIG. 9, after the upper protective sheet has been removed from the indicator sheet, and the lid flap has been pressed down against the indicator sheet that lies on the base flap.

FIG. 10 shows the assembly of FIG. 9, after food or other goods have been placed in the base cavity, a store clerk has peeled off the top protective sheet, and the lid flap has been pressed down towards the base flap, with only the indicator sheet 34 between them. The lid flap 22 has been pressed down firmly so the character 60 adheres to the lid flap. When the lid flap begins to be pulled up during a first opening of the container, as in FIG. 6, the carrier 64 remains on the base flap at least partially because of the highly adhesive layers 102, 104 that hold the front and rear edge regions of the carrier to the base flap. The characters 60 tend to move upward with the lid flap. This can be assured by placing a barrier indicated at 100 in FIG. 6, of non-adhesive release material, under the bottom of only the middle region 68 of the character sheet where the characters are located. Some or all of the characters will adhere to the lid flap 22. It is even possible to place a drop of highly adhesive material on the top of one or a few of the characters to assure that at least one character will stick to the lid flap.

Figure 11:
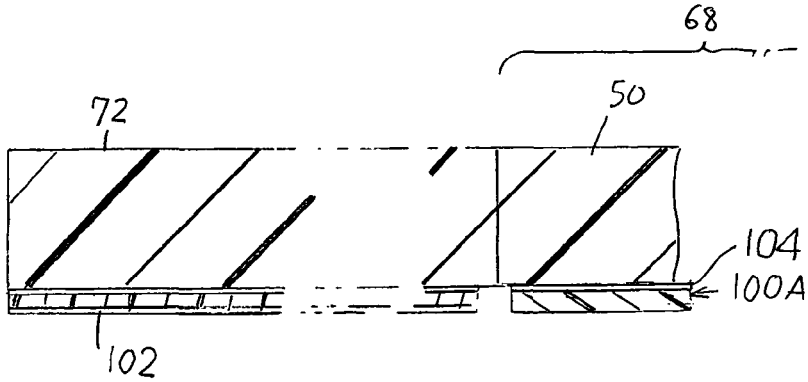
FIG. 11 is an enlarged view of a portion of the apparatus of FIG. 10, and with a black release and background strip.

When the lid is closed after it has been first opened, the character 60 will be shifted by the bending and displacement of the flaps, especially the lid flap, so the character such as 60 will not fit into the hole 62 in the carrier that it was pulled out of during opening of the container. Instead, as shown in FIG. 7, there will be uncovered gaps 42 in the carrier strip 64. A person looking at the indicator sheet 34 of FIG. 2 though the transparent lid flap 22 will see a largely white strip with gaps in the white strip where the holes have not been covered. The color seen though the gaps will be easily noticed. A black background strip can be placed under the adhesive sheet or even at the bottom of the base flap to enhance the contrast between the white strip and the gaps in it. FIG. 11 shows a black background strip 100A under the middle region 68, with a lower release surface that does not stick to the base flap and an upper adhesive layer 104 that sticks to the middle region. It is possible to merely paint the bottom of carrier middle region.

Where only one side of the container lid can be lifted because the other side is pivotally connected to the base, only one indicator strip is required. Where both sides of the container can be lifted so either one of the container opposite sides can be lifted to open the container, an indicator sheet is preferably placed on the flaps at both opposite sides of the container. Use of the term "strip" does not mean that a sheet is elongated. Such indicator strips can be placed at opposite sides of the container such as at the opposite long sides. Instead of a white strip, other contrasting colors can be used for the character sheet and the backup sheet. Although the indicator strip assemblies were designed for food containers, they can be used to hold containers for other goods.

Thus, the invention provides the combination of a container having at least one pair of base and lid flaps, and an indicator sheet or strip which indicates if the lid has been opened after the indicator strip was fully installed, which occurs after goods are loaded into the container. The indicator sheet has at least one cut that forms a hole and a character in the hole, and a carrier that surrounds the hole and the character therein. The hole could extend to the front or rear edge of the indicator sheet. The indicator sheet has a first adhesive surface that holds down the carrier to the base flap, and has another adhesive surface the holds the character to the lid flap when the lid flap is raised away from the base flap. There is zero or a lesser holding strength of the carrier for the lid and of the character for the base. As a result, when the lid flap is raised, the character is lifted out of its hole. When the lid flap is next lowered towards the base flap, the character will be lowered to a position offset from its original position, creating a gap between part of the character and the walls of the hole. The offsetting creates a gap which can be readily seen, to indicate to customers that the container has been opened since it was first closed after goods were loaded into the container. It is possible to adhere the character to the base and adhere the carrier to the lid, although that is not preferred.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A container comprising:

a base having a base peripheral portion and a lid having a lid peripheral portion, the base and the lid forming a cavity therebetween when in a closed configuration; and an indicator sheet disposed between the base peripheral portion and the lid peripheral portion, the indicator sheet comprising a first portion and a second portion defined by a cut, wherein the first portion is adhesively held to the base peripheral portion by a first holding strength and the second portion is adhesively held to the lid peripheral portion by a second holding strength; and further wherein the base peripheral portion and the lid peripheral portion have a first position relative to each other when first placed in the closed configuration and a second position when subsequently placed in the closed configuration, the first position and second position of the indicator sheet being offset from each other in the second position.

2. The container of claim 1, wherein the indicator sheet comprises an exposed surface of a first color and a layer of a second color, wherein the layer is exposed when in the second position.

3. The container of claim 1, wherein the layer of a second color comprises a background strip.

4. The container of claim 1, wherein at least one of the first portion and the second portion defines a character.

5. The container of claim 1, wherein the character is not visible when the first portion and the second portion are in the first position.

6. The container of claim 1, wherein the first portion is adhesively held to the lid peripheral portion by a holding strength less than the first holding strength.

7. The container of claim 1, further comprising a second indicator sheet disposed between the base peripheral portion and the lid peripheral portion, the second indicator sheet being spaced from the first indicator sheet.

8. The container of claim 1, wherein the base peripheral portion comprises a base flap, and the lid peripheral portion comprises a lid flap.

9. The container of claim 1, further comprising a latching mechanism constructed to shift the base peripheral portion relative to the lid peripheral portion when in the second position.

10. The container of claim 9, wherein said latch mechanism comprises a lid projection and a base recess.

11. The container of claim 1, wherein the second portion is adhesively held to the base peripheral portion by a holding strength less than the second holding strength.

12. The container of claim 11, wherein the first portion is adhesively held to the lid peripheral portion by a holding strength less than the first holding strength.

13. The container of claim 12, wherein all of the first portion releases from the lid peripheral portion and all of the second portion releases from the base peripheral portion when the base peripheral portion is moved from the lid peripheral portion.

14. A method of assembling a tamper-evident container comprising:

forming a base having a base peripheral portion and a lid having a lid peripheral portion, the base and the lid forming a cavity therebetween when in a closed configuration; and disposing an indicator sheet between the base peripheral portion and the lid peripheral portion, the indicator sheet comprising a first portion and a second portion defined by a cut, wherein the first portion is adhesively held to the base peripheral portion by a first holding strength and the second portion is adhesively held to the lid peripheral portion by a second holding strength; and further wherein the base peripheral portion and the lid peripheral portion have a first position relative to each other when first placed in the closed configuration and a second position when subsequently placed in the closed configuration, the first position and second position of the indicator sheet being offset from each other in the second position.

* * * * *